United States Patent [19]

Hofstede

[11] Patent Number: 4,860,948

[45] Date of Patent: Aug. 29, 1989

[54] FOLDABLE BOX AND BLANK THEREFOR

[76] Inventor: Wilhelmus Hofstede, 3772 KK Barneveld, Livingstonestraat 94, Netherlands

[21] Appl. No.: 244,522

[22] Filed: Sep. 9, 1988

Related U.S. Application Data

[63] Continuation of Ser. No. 906,582, Sep. 19, 1986, abandoned, which is a continuation of Ser. No. 581,298, Feb. 17, 1984, abandoned.

[51] Int. Cl.[4] ..... B65D 5/36

[52] U.S. Cl. ..... 229/143; 229/23 C; 229/41 R; 229/169; 229/199; 229/918; 229/DIG. 11

[58] Field of Search ..... 229/143, 160, 169, 199, 229/23 C, 41 R, 41 B, 915, 918, DIG. 11

[56] References Cited

U.S. PATENT DOCUMENTS

| | | | |
|---|---|---|---|
| 887,352 | 5/1908 | Sommer | 229/160 |
| 1,097,390 | 5/1914 | Corwin | 229/DIG. 2 |
| 1,658,954 | 2/1928 | Vance | 229/199 |
| 2,089,345 | 8/1937 | Davis et al. | 229/34 A |
| 2,160,643 | 5/1939 | Burel | 229/41 B |
| 2,295,515 | 9/1942 | Hoag | 229/41 B |
| 2,634,046 | 4/1953 | Weber | 229/DIG. 4 |
| 2,734,677 | 2/1956 | Arneson | 229/41 B |
| 2,749,015 | 6/1956 | Pennebaker | 229/160 |
| 2,987,236 | 6/1961 | Strine | 229/34 R |
| 3,102,674 | 9/1963 | Hamilton | 229/34 HW X |
| 3,534,900 | 10/1970 | Hutchins | 229/160 |
| 3,907,193 | 9/1975 | Heller | 229/DIG. 4 |
| 3,913,822 | 10/1975 | Heaps, Jr. | 229/DIG. 4 |
| 3,968,923 | 7/1976 | Bell et al. | 229/34 R |
| 4,058,249 | 11/1977 | Buck | 229/169 |
| 4,349,147 | 9/1982 | Jensen | 229/34 R |
| 4,385,721 | 5/1983 | Olsen et al. | 229/143 |

FOREIGN PATENT DOCUMENTS

| | | | |
|---|---|---|---|
| 995637 | 8/1976 | Canada | 229/31 FS |
| 31733 | 7/1981 | European Pat. Off. | 229/31 R |
| 1213709 | 4/1960 | France | 229/23 C |
| 1222705 | 6/1960 | France | 229/23 C |
| 1236617 | 6/1960 | France | 229/23 C |
| 1247222 | 10/1960 | France . | |
| 1596118 | 6/1970 | France . | |
| 2481230 | 10/1981 | France | 229/31 R |
| 2510970 | 2/1983 | France | 229/36 |
| 590080 | 3/1959 | Italy | 229/34 R |
| 524924 | 8/1940 | United Kingdom | 229/33 |
| 744151 | 2/1956 | United Kingdom | 229/33 |
| 934367 | 8/1963 | United Kingdom | 229/31 R |
| 1395269 | 3/1965 | United Kingdom | 229/32 |
| 1280851 | 7/1972 | United Kingdom | 229/31 FS |
| 1381469 | 1/1975 | United Kingdom | 229/32 |
| 2057398 | 4/1981 | United Kingdom | 229/32 |

*Primary Examiner*—Stephen Marcus
*Assistant Examiner*—Gary E. Elkins
*Attorney, Agent, or Firm*—Ladas & Parry

[57] ABSTRACT

A foldable box with a bottom wall (1) and upright walls (2,3,67), one pair of walls (6, 7) being provided with foldable widening strips (10, 11) and foldable lengthening flaps (14, 15; 16, 17), whereas in one pair of walls (6, 7) from each of the bottom corner points an oblique folding line (26, 27; 28, 29) is provided extending upwardly at an angle of about 45°. According to the invention the foldable widening strips (10, 11) are folded in a position parallel to the bottom (1), the oblique folding lines (26, 27; 28, 29) in the one pair of walls (6, 7) are lengthened in the widening strips and in the widening strips (10, 11) from the end points of the folding line (12, 13) between the widening strip and the wall each time a second oblique folding line (30, 31; 32, 33) is provided parallel to the first mentioned oblique folding line.

4 Claims, 2 Drawing Sheets

FOLDABLE BOX AND BLANK THEREFOR

This is a request for a filing under the file wrapper continuing application procedure, 37 CFR 1.62, for a continuation of prior complete application Ser. No. 906,582, filed on Sept. 9, 1986 abandoned, which is a cont. of Ser. No. 581,298 filed 2/17/1984, abandoned.

The present invention relates to a foldable box with a bottom and two pairs of opposed upright walls which are foldably connected with the bottom and at their head ends are interconnected by means of overlapping upright wall parts, the one pair of walls being provided with foldable widening strips and foldable lengthening flaps, wherein at least a part of the lengthening flaps is fixed to a corresponding part of the other pair of walls, whereas in one pair of walls from each of the bottom corner points an oblique folding line is provided extending upwardly at an angle of about 45°.

A similar foldable box is described in the not prepublished Dutch patent application 81 05838. In this earlier prepared box the one pair of opposed walls and the wall parts connected therewith, which overlap each of the other upright walls, are provided with striplike extensions which are foldable about folding lines, said folding lines at the location of the corners of the box being spaced from each other by an excision and from the ends and from the middle of these excisions vertical folding lines being provided so that in each of the corners of the box a re-entrant corner is formed with the respective corner wall parts of the box, whereas in the other pair of upright walls from each of the bottom corner points of the box an oblique folding line is provided extending upwardly at an angle of about 45°. Therewith the strip-like extension of the one pair of opposed upright walls, which are foldable about the folding lines, are fastened in an overlapping manner to that pair of opposed walls and the wall parts connected therewith, except at the location of the re-entrant corners. In the re-entrant corners a reinforcing member is provided, consisting of a compressible support leg. These support legs serve to carry the weight in the event of stacked, filled boxes. Since the support leg is compressible, the leg can remain in the box during folding. A disadvantage of this earlier prepared box is that the support legs have to be made, stored and provided separately, which requires additional personnel and makes the box more expensive. Moreover, it is not guaranteed upon frequent use by different persons that the support legs remain in the re-entrant corners, especially not in case the boxes are used for the package of vegetables, fruit and the like, whereby the boxes are exposed to a rough treatment on public sales, markets and in shops.

The present invention aims at removing the objections of the earlier prepared box.

This aim is achieved in that according to the invention the foldable widening strips are folded in a position parallel to the bottom, in that the oblique folding lines in the one pair of walls are lengthened in the widening strips and in that in the widening strips from the end points of the folding line between the widening strip and the wall each time a second oblique folding line is provided parallel to the first mentioned oblique folding line.

Owing to the fact that the foldable widening strips are folded in a position parallel to the bottom, in the upper plane of the box partially an upper wall is formed, consisting of supporting walls or stacking walls at two opposite ends of the box and these supporting or stacking walls carry the weight in the event of stacked, filled boxes. Thanks to the widening strips, moreover, the one pair of upright walls, to which they are provided, remains upright in the upright position of the box and, furthermore, these upright walls remain straight thereby, so that also the other pair of upright walls remains upright. This facilitates the filling of the box. Owing to the fact that the oblique folding lines in the one pair of walls are lengthened in the widening strips and that in the widening strips from the end points of the folding line between the widening strip and the wall each time a second oblique folding line is provided parallel to the first mentioned oblique folding line, the box according to the invention, inspite of the presence of the supporting walls in the upper wall of the box, can be brought from the folded into the unfolded position in one single action by simply folding up the one pair of upright walls of the box.

In a preferred embodiment of the foldable box according to the invention the other pair of walls is provided with foldable lengthening flaps, which with a part of their surface are fastened to a corresponding part of the one pair of walls, and these lengthening flaps are provided with foldable second widening strips, which are folded in a position parallel to the bottom and come to lie under the first mentioned widening strips.

By application of these measures the said one pair of walls is reinforced by fastening the lengthening flaps of the other pair of walls thereto and, moreover, the supporting or stacking walls in the upper surface of the box are at least locally doubled and thereby reinforced.

In a very efficient embodiment of the foldable box according to the invention the other pair of opposed walls is near both ends provided with foldable third widening strips, which are also folded in a position parallel to the bottom and which come to lie under the first mentioned widening strips.

Hereby the supporting or stacking wall is lengthened along the other pair of walls of the box, whereby the supporting capacity of the box is further increased.

The invention also relates to a blank for a foldable box provided with a bottom panel and two pairs of opposed wall panels which are foldably connected with the bottom panel, the one pair of wall panels being provided with widening strips which are connected with the wall panels by folding lines and with lengthening flaps which are connected with the widening strips by folding lines, and in one pair of wall panels from each of the corner points of the bottom panel an oblique folding line being provided extending at an angle of about 45° with respect to the folding line between the wall panel and the bottom panel.

Such a blank is described in the not prepublished Dutch patent application 81 05838.

The blank according to the present invention differs from this earlier prepared blank in that the wall panels, first widening strips and lengthening flaps thereof of the one pair of walls are cut out in T-shape, in that the said oblique folding lines are provided in that pair of wall panels and are lengthened in the widening strips and in that in the widening strips of the one pair of wall panels from the end points of the folding line between the widening strip and the wall panel each time a second oblique folding line is provided parallel to the first mentioned oblique folding line.

In a preferred embodiment of the blank according to the invention the other pair of wall panels is provided with lengthening flaps, which are connected with the end edges of said wall panels by folding lines, and these lengthening flaps at their outer side are provided with second widening strips which are connected with said lengthening flaps by folding lines.

The invention will be further elucidated with an embodiment, on the basis of the drawings.

Figure 1:
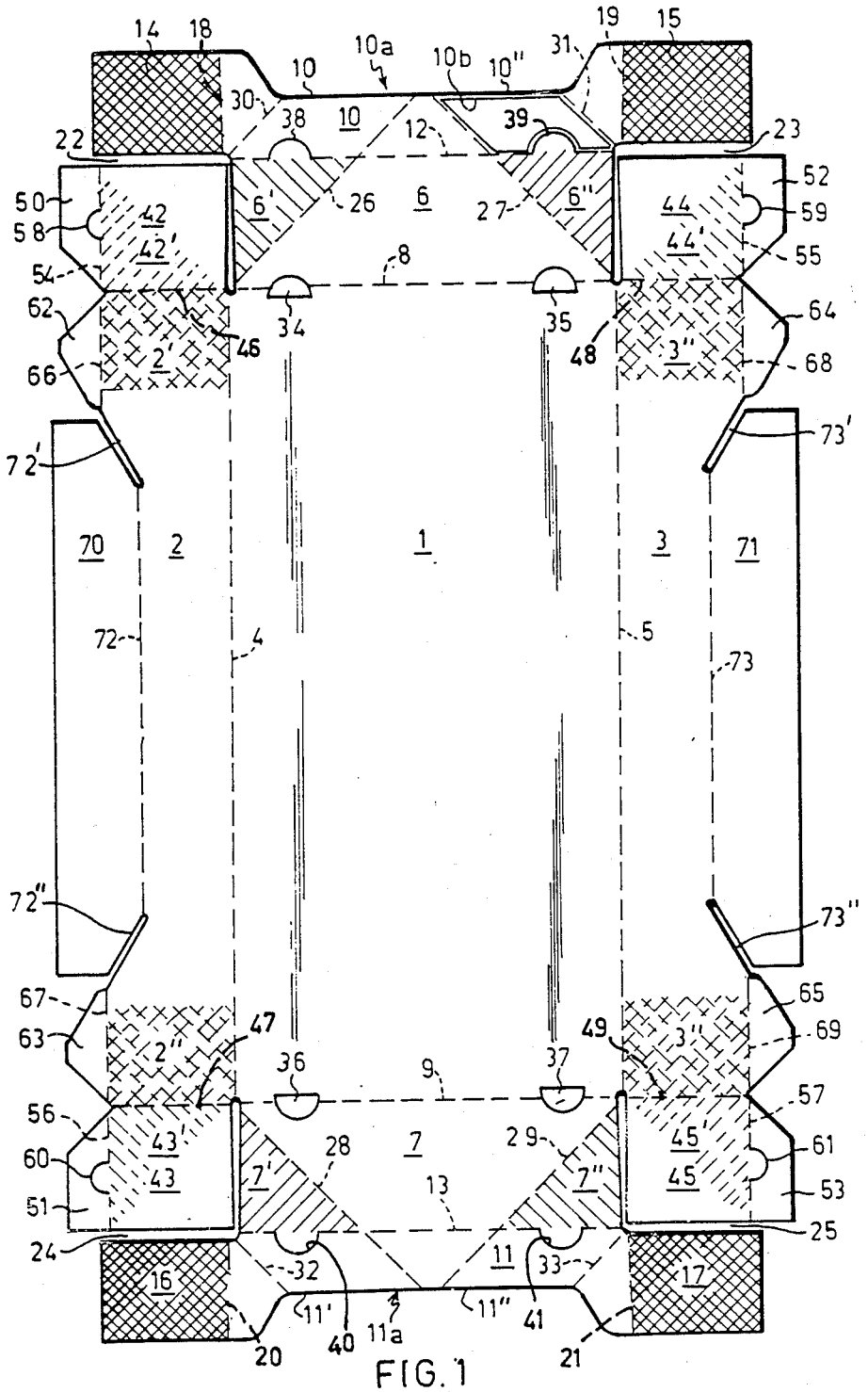
FIG. 1 is a plan view of a blank for a foldable box according to the invention.
Figure 2:
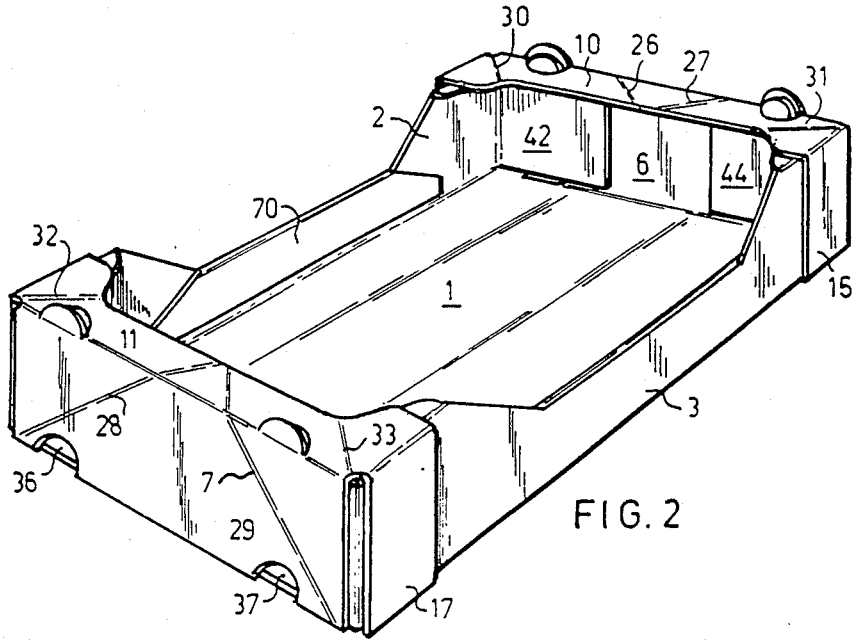
FIG. 2 is a perspective view of the foldable box according to the invention.

The blank according to the invention, illustrated in FIG. 1, consists of e.g. a cardboard sheet, which is cut out in the desired shape. The blank consists of a bottom panel 1, two side wall panels 2 and 3, which are connected with the bottom panel along folding lines 4 and 5, respectively, and of end wall panels 6 and 7 which are connected with the bottom panel 1 along folding lines 8 and 9. The end wall panels 6 and 7 are provided with widening strips 10 and 11, respectively, which are connected with the end wall panels 6 and 7, respectively, along folding lines 12 and 13, respectively. The widening strips 10 and 11 are provided with recesses 10a and 11a to promote the accessibility of the folded box, vide FIG. 2, both upon filling and upon removal of products or articles packed in the box.

At the end edges of the widening strips 10 and 11 lengthening flaps 14, 15 and 16, 17, respectively, are provided, which are connected with the widening strips by folding lines 18, 19 and 20, 21, respectively. The end portions 6, 10, 14, 15 and 7, 11, 16, 17 of the blank are cut out in T-shape and separated from the remaining part of the blank by angle steel shaped grooves 22, 23 and 24, 25, respectively.

In each assembly of end wall panel 6, 7 and widening strip 10, 11 from the end points of the folding lines 8 and 9 two folding lines 26, 27 and 28, 29, respectively, are provided, which include an angle of about 45° with the folding lines 8 and 9, respectively. Furthermore, in the widening strips 10 and 11 from the end points of the folding lines 12 and 13 second folding lines 30, 31 and 32, 33, respectively, are provided parallel to the folding lines 26, 27 and 28, 29 respectively.

In the folding lines 8 and 9 a number, e.g. two, of semi-circular recesses 34, 35 and 36, 37, respectively, are cut out, which are partially situated in the bottom panel 1 and partially in the end wall panels 6 and 7, and in the folding lines 12 and 13 semicircular cuts 38, 39 and 40, 41, respectively, are provided. The function of the recesses and cuts will be elucidated herebelow.

The side wall panels 2 and 3 at their end edges are provided with lengthening flaps 42, 43 and 44, 45, respectively, which are connected with the side wall panels 2 and 3 by folding lines 46, 47 and 48, 49 respectively. The lengthening flaps 42, 32 and 44, 45 at their outer side are provided with second widening strips 50, 51 and 52, 53, respectively, which are connected with the widening strips by folding lines 54, 55 and 56, 57, respectively. In the folding lines 54, 55 and 56, 57, respectively, semi-circular cuts 58, 59 and 60, 61, respectively, are provided, the function of which will be elucidated later on.

Furthermore, the side wall panels 2 and 3 near their end edges at their outer side are provided with third widening strips 62, 63 and 64, 65, which are connected with the side wall panels 2 and 3 by folding lines 66, 67 and 68, 69.

Finally, the side wall panels 2 and 3 in the middle are provided with folding strips 70 and 71, respectively, which are connected with the side wall panels 2 and 3 by folding lines 72 and 73, respectively. Cut-out grooves 72' and 72'' and 73' and 73'', respectively, are connected to the folding lines 72 and 73. The function of the folding strips will be elucidated later on.

Figure 3:
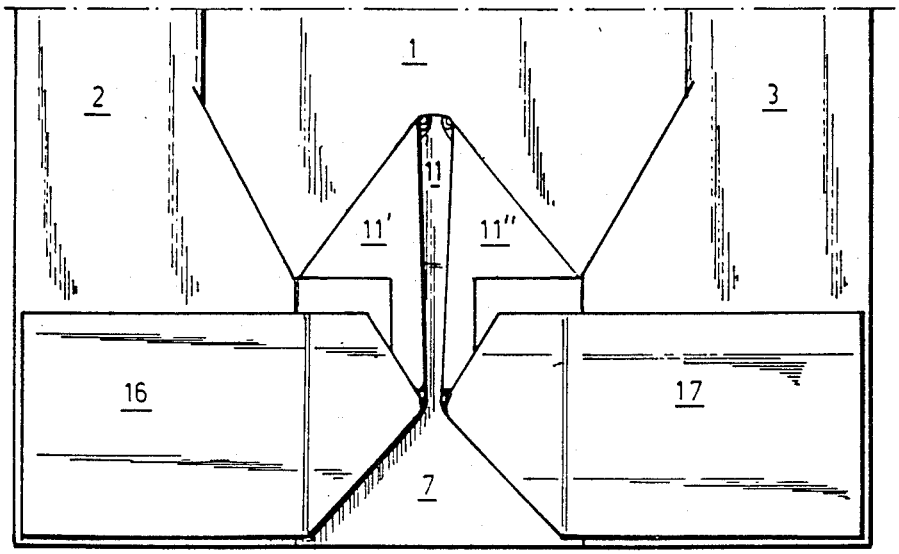
FIG. 3 is a plan view of a part of the foldable box according to the invention.

The mounting of the folded box, vide FIG. 3, from the blank according to FIG. 1 occurs as follows:

The end wall 6, 10 is folded inwardly on the bottom 1 about the folding line 8 and at the same time the hatched parts 6' and 6'' together with the parts 10', 14 and 10'', 15, respectively, and the lengthening flaps 14 and 15, respectively, are folded back outwardly over about 180° on the end wall 6 about the folding lines 26 and 27, respectively.

Then the folding strips 70 and 71 are provided with glue and folded inwardly about the folding lines 71 and 73 and adhered to the side wall panels 2 and 3.

Thereafter the lengthening flaps 42 and 44 are folded on the hatched parts 2' and 3' about the folding lines 46 and 48.

At the end wall 7, 11 the same method is followed as described above for the end wall 6, 10.

Thereafter the hatched parts 6', 6'' and 7', 7'' are provided with glue and both side wall panels 2 and 3 are folded inwardly about the folding lines 4 and 5, whereby the hatched parts 42', 44' with their bottom side (FIG. 1) are adhered to the hatched parts 6', 6'' provided with glue and the hatched parts 43', 45' to the parts 7', 7''. Finally, the lengthening flaps 14, 15 and 16, 17 are provided with glue at the upper side (FIG. 1), folded about the folding lines 30, 31 and 32, 33 and adhered to the bottom side (FIG. 1) of the hatched parts 2', 3' and 2'', 3''. Then the folded box according to the invention, which is partially represented in FIG. 3, is finished and these boxes can be stored in large numbers in a relatively small space, e.g. in the stores of the box manufacturer.

The box according to the invention is folded in the above described way by the manufacturer and delivered to the user in folded state. The user can simply fold the box open or "put up" same, viz. by pulling the end walls 6 and 7 upwardly by hand and, if necessary, by folding the widening strips 10 and 11 squarely to the end walls 6 and 7.

When stacking of the foldable boxes according to the invention the lips of a lower box, which are formed by the cuts 38–41 and 58–61, protrude in the recesses 34–37 of an upper box, so that the boxes cannot be shifted with respect to one another. By the folding of the folding strips 70 and 71 in the side wall panels 2 and 3 ventilation openings are formed when the boxes are stacked one above the other. These ventilation openings e.g. may be necessary when the stacked boxes are filled with moisture spreading products, like fruit and vegetables.

By applying different types of cardboard the foldable boxes according to the invention can be adapted to the load requirements with a certain use of the boxes, said requirements being dependent on the weight of the filled boxes, the stacking height, the way of of transport, etc.

The box according to the invention is preferably made of solid cardboard, which can be applied in different widths. Of course also other materials, such as synthetic materials, can be used.

If it is desired to further reinforce the supporting or stacking wall e.g. when one wishes to use a box suited for rather light products for rather heavy products, cardboard or wooden reinforcing plates 10b can be fastened e.g. adhered to the first widening strips 10, 11 on at least a part 10', 10'' and 11' and 11'' at the inwardly directed side thereof.

The box according to the invention can be substantially reinforced as to supporting capacity by locally fastening a reinforcing plate of cardboard, synthetic or other rather rigid material, to the hatched parts 2'-2'', 3'-3'' and/or to the end wall panels 6 and 7 within the folding lines 26, 27 and 28, 29.

On the widening strips 10, 11 and the lengthening flaps 14, 15 and 16, 17 for additional reinforcement and increase of the supporting capacity another strip of syntentic or other rather rigid material can be adhered, said strip at the location of the folding lines 18, 30, 26, 27, 31, 19 and the folding lines 20, 32, 28, 29, 33, 21, respectively, in the widening strips 10 and 11 being provided with so-called "synthetic hinges", where the material is made thinner and thereby foldable, said strip at the location of the cardboard lips formed by the cuts 38–41 being provided with lips formed thereon, having the same function as the cardboard lips.

Furthermore, the box can be carried out single- or double-walled and although a rectangular embodiment is described and represented in the drawings also a square shape could be applied, whereby the boxes, moreover, can be made in various sizes.

Although in the described and represented embodiment the stacking or supporting edge is formed on the short sides of the box, this supporting edge can also be formed on the long sides.

Furthermore, in order to prevent shifting with respect to one another, one upright lip at the end walls and one recess in the bottom and the end wall can be sufficient, which are provided in the middle then. Also the box may somewhat taper in vertical direction, i.e. that the bottom has a smaller surface than the upper side, in which case the recesses can be omitted.

I claim:

1. A foldable box comprising a bottom (1), a first (6,7) and a second pair (2,3) of opposed upright walls being foldably connected to the bottom, the first pair of walls being provided with first widening strips (10,11), said first widening strips being foldable along a line (12,13) between each said strip and each first wall, said first widening strips being provided with first foldable lengthening flaps (14,15,16,17), at least a part of said first lengthening flaps being fastened to a corresponding part of the second pair (2,3) of opposed upright walls, said first pair of upright walls each having first oblique folding lines (26,27,28,29) extending from a corner defined by a folding line (8,9) between said first pair of walls and said bottom and a folding line (4,5) between said bottom and each of said second pair of walls, said first oblique folding lines of each wall of said first pair of walls including an angle of about 45° with the folding lines between said first pair of walls and said bottom;

said foldable box further comprising said first foldable widening strips (10,11) being folded at a position of being substantially parallel to the bottom so that the first oblique folding lines of the first pair of walls are extended in the widening strips, each said widening strip having second oblique folding lines (30,31,32,22) crossing each said widening strip from the folding line between said first wall (12,13) and said widening strip (10,11), said second oblique lines (30,31,32,33) being substantially parallel to said first oblique lines (26,27,28,29);

said second pair of upright walls being provided with second lengthening flaps (42,43,44,45), each corner of said box comprising one of said second lengthening flaps (42,43,44,45) and a corresponding one of said first pair of walls (6,7) attached together by means for attaching applied only to a portion of said one of said first pair of walls defined by said first oblique line (26,27,28,29) and said folding line (12,13) between each first wall (6,7) and each first widening strip (10,11) and to the portion to said second lengthening flap (42,43,44,45) that contacts said defined portion, whereby at least said first pair of upright walls (6,7) in their assembled condition are foldable in the direction of the bottom.

2. The foldable box according to claim 1, wherein said means for attaching is glue.

3. In a foldable box comprising a bottom; a first pair of opposed upright walls foldably connected along a line to said bottom, said walls having first widening strips foldably connected along a line to said walls, each of said first pair of walls having a pair of first oblique folding lines, each said oblique folding line extending from a corner of the box and including an angle of substantially 45° with said folding lines of said first pair of walls, each of said first widening strips having a pair of second oblique folding lines each of which is substantially parallel to one of said first folding lines;

a second pair of opposed upright walls foldably connected along a line to said bottom, a corner construction comprising at each corner of said box;

a first lengthening flap foldably attached to one of said first widening flaps and having at least a portion thereof attached to one of said second pair of walls;

a second lengthening flap foldably attached to one of said second pair of walls and folded towards an interior of said box to contact an interior side of one of said first pair of walls;

means for attaching said second lengthening flap to said one of said first pair of walls only in a region defined by one of said first oblique lines and said line foldably connecting one of said first widening strips to said one of said first pair of walls, whereby at least said first pair of upright walls (6,7) are foldable in the direction of the bottom.

4. Corner construction according to claim 3, wherein said means for attaching is glue.

* * * * *